US005450175A

United States Patent [19]

Sato et al.

[11] Patent Number: 5,450,175

[45] Date of Patent: Sep. 12, 1995

[54] IMAGE FORMING APPARATUS HAVING OPTICAL MEANS FOR IMAGE MAGNIFICATION CHANGE

[75] Inventors: Toshiya Sato; Naoki Otomo, both of Hachioji, Japan

[73] Assignee: Konica Corporation, Tokyo, Japan

[21] Appl. No.: 261,470

[22] Filed: Jun. 17, 1994

[30] Foreign Application Priority Data

Jul. 27, 1993 [JP] Japan ..... 5-185197

[51] Int. Cl.[6] ..... G03G 15/04

[52] U.S. Cl. ..... 355/243; 355/232; 355/235; 355/55; 355/58; 359/819; 359/822; 359/824

[58] Field of Search ..... 355/55, 58, 59, 243, 355/232, 235, 237; 359/811, 813, 814, 819, 822, 823, 824, 825

[56] References Cited

U.S. PATENT DOCUMENTS

| | | | |
|---|---|---|---|
| 3,765,760 | 10/1973 | Mochimaru | 355/58 |
| 4,093,374 | 6/1978 | Zucker et al. | 355/58 X |
| 4,139,298 | 2/1979 | Tani | 355/243 X |
| 4,158,497 | 6/1979 | Suzuki et al. | 355/57 X |
| 4,421,405 | 12/1983 | Nagahara | 355/58 |
| 4,555,165 | 11/1985 | Negoro | 355/55 X |
| 4,557,594 | 12/1985 | Negoro | 355/58 |
| 4,868,603 | 9/1989 | Russell | 355/58 |

FOREIGN PATENT DOCUMENTS

| | | | |
|---|---|---|---|
| 57-195260 | 11/1982 | Japan . | |
| 59-182431 | 10/1984 | Japan . | |
| 60-112239 | 7/1985 | Japan . | |
| 61-70844 | 5/1986 | Japan . | |
| 2-193167 | 7/1990 | Japan | 355/243 |
| 316082 | 7/1929 | United Kingdom | 355/58 |
| 1402025 | 8/1975 | United Kingdom | 355/58 |

*Primary Examiner*—Matthew S. Smith

*Attorney, Agent, or Firm*—Frishauf, Holtz, Goodman, Langer & Chick

[57] ABSTRACT

An image forming apparatus has an optical device for image magnification change. The apparatus is provided with a fixed platen on which a document is placed, four reflecting mirrors and an exposure lamp by which the document is exposed and scanned, and a lens unit including a fixed-focus lens by which an image of the document is formed on an image carrier. An imagewise light emitted from a document is reflected by the first, second and third reflecting mirrors and is transmitted through the fixed-focus lens. The reflected light is projected into the image carrier by way of the fourth reflecting mirror at which the light transmitted by the fixed-focus lens is reflected. The lens unit accommodates the fixed-focus lens and is movable in the same moving direction as the first, second and third reflecting mirrors at the time of an image magnification change operation. A lens cam member is mounted on the lens unit. The lens cam member has a first cam surface for enlargement and a second cam surface for reduction on at least one side thereof. An operation member has a first operation member which carries the cam surface for enlargement operations, and a second operation member which carries the cam surface for reduction operations. An interlock member interlocks with the fourth reflecting mirror so that a moving amount of the first operation member when engaged with the first and second cam surfaces, causes a movement of the fourth reflecting mirror based on the movement amount of said operation member.

6 Claims, 4 Drawing Sheets

IMAGE FORMING APPARATUS HAVING OPTICAL MEANS FOR IMAGE MAGNIFICATION CHANGE

BACKGROUND OF THE INVENTION

The present invention relates to an image forming apparatus in which an original document is placed on a platen, the apparatus having a moving exposure lamp, a plurality of reflection mirrors, and a fixed focal length lens, a document image being formed on an image carrier, and specifically relates to an optical mechanism for image magnification change.

In an image forming apparatus, specifically, an exposing apparatus which exposes the document is provided with: an exposing lamp which exposes the document from the lower surface of the platen; a first scanner unit into which the first reflection mirror is assembled; a plurality of reflection mirrors which receive the reflected light from the first reflection mirror, and form an image with an image forming lens; and a final reflection mirror which sends the document image from the image forming lens to the image carrier. When the image forming lens and the final reflection mirror are moved in the direction of the optical axis of the image forming lens, an enlargement or reduction operation of the document image is conducted in the image forming apparatus. In the operation for selecting enlargement or reduction of the document, since a movement amount of the image forming lens and that of the final reflection mirror are different from each other, the following publications are widely known as a means in which a lens cam member is provided into a frame of the image forming lens, or a means in which image is formed by a lens cam member which is interlocked with the frame of the image forming lens: Japanese Patent Publication Open to Public Inspection Nos. 195260/1982 and 182431/1984, and Japanese Utility Model Publication Nos. 112239/1985 and 70844/1986.

As described above, in a means, in which the lens cam member is provided in a lens unit in which the image forming lens is housed, and the reflection mirror is moved through an operating member so that an electrostatic latent image is formed onto the image carrier, since an error of the focal length (normally, ±1%) produced in the manufacturing process can not be allowed, the following methods have been adapted: a method in which various lens cam members having different surface inclination are prepared, and the lens cam member having the smallest error is used; and a method in which the lens cam member is divided into an enlargement portion and a reduction portion and is adjusted.

As described above, the cam surface for enlargement and that for reduction are formed in the lens cam member provided in the lens unit. The cam surfaces for enlargement and for reduction are formed on the one surface of the lens cam member including the cam surface for reference copying, the cam surfaces are contacted with a portion of the operation member, and the lens unit is moved and also the lens cam member is moved. In this connection, for the purpose that the entire cam surfaces for enlargement and for reduction act on a portion of the operation member, the lens cam member becomes large, and it is necessary that the lens cam member is largely moved. Accordingly, it is necessary that a large space for operation is formed corresponding to the movement distance in an exposure section, so that the entire apparatus becomes large, which is disadvantageous.

Further, as described above, in order to reduce the error of the focal length in the manufacturing process as small as possible, it is necessary that various lens cam members, in which cam surfaces for enlargement and for reduction are different from each other, are prepared. Accordingly, the manufacturing cost is increased, and a long period of time is necessary in order to select the lens cam member for correcting the error of the focal length, which are largely disadvantageous.

SUMMARY OF THE INVENTION

An object of the present invention to form a smaller size lens cam member having the cam surface for enlargement and for reduction, and to provide the lens cam member which can be adjusted for correcting errors of the focal length.

In order to accomplish the foregoing objects, in an image forming apparatus in which a document image is formed on an image carrier by a fixed platen on which the document is placed, a plurality of reflection mirrors and an exposure lamp for exposure-scanning the document and a fixed focal length lens, the first embodiment of the present invention has the exposure lamp, the first reflection mirror in the plurality of reflection mirrors, the second and third reflection mirrors which receive the reflection light from the first reflection mirror and cause the document image to be reflected from the fixed focal length lens, and the final reflection mirror which reflects the document image, reflected from the fixed focal length lens, onto the image carrier, and comprises: a lens unit in which the fixed focal length lens is housed, and which can move in the same direction as the movement direction of the first, second, and third reflection mirrors at the time of an image magnification change operation; a lens cam member which is mounted on the lens unit, and which has the cam surfaces for enlargement and for reduction on both sides of the lens cam member; and an operation member having the first operation member which contacts the cam surface for enlargement operations, and the second operation member which contacts the cam surface for reduction operations; and an interlocking member which interlocks with the final reflection mirror corresponding to the movement amount of the operation member for changing its position when the first operation member and the second operation member are operated by the cam surfaces for enlargement and for reduction.

The second embodiment of the present invention is characterized in that: the lens cam member is provided so that positions of the lens cam member can be adjusted with respect to the lens unit.

The third embodiment of the present invention is characterized in that: cam surfaces for enlargement and for reduction are composed of lens cam members divided respectively, and the divided cam member is provided so that positions of the divided cam member can be adjusted with respect to the lens unit.

The fourth embodiment of the present invention is characterized in that: in an image forming apparatus, in which the document image is formed onto the image carrier by a platen on which the document is placed, a plurality of reflection mirrors and an exposure lamp by which exposing-scanning is conducted on the document, and the document image is formed on the image carrier by a fixed focal length lens, the image forming apparatus is structured so that the following units, members and portions can be moved and adjusted in the direction perpendicular to the optical axis of a fixed focal length lens: a lens unit having; the exposure lamp and the first reflection mirror of a plurality of reflection mirrors; the second and third reflection mirrors which receive the reflection light reflected from the first reflection mirror, and in which the document image is reflected by the fixed focal length lens; a final reflection mirror by which the document image sent from the fixed focal length lens is reflected onto the image carrier, the fixed focal length lens is being housed in the lens unit, which can be moved in the same direction as the movement direction of the first, second, and third reflection mirrors at the time of image magnification change; a lens cam member which is fixed in the lens unit, and which has a cam surface for enlargement and a cam surface for reduction on one surface of the lens cam member; and operating members each having the first operating member which operates in contact with cam surfaces for enlargement and for reduction, and the second operating member which interlocks with the the first operating member, rotated around the shaft so that the position of the final reflection mirror is changed; and the position of the shaft.

In the image forming apparatus of the fifth embodiment, the lens cam member is rotated around the shaft of the reference position provided in the lens unit so that positions of the cam surfaces for enlargement and for reduction can be adjusted.

DETAILED DESCRIPTION OF THE PREFERRED EMBODIMENTS

Figure 1:
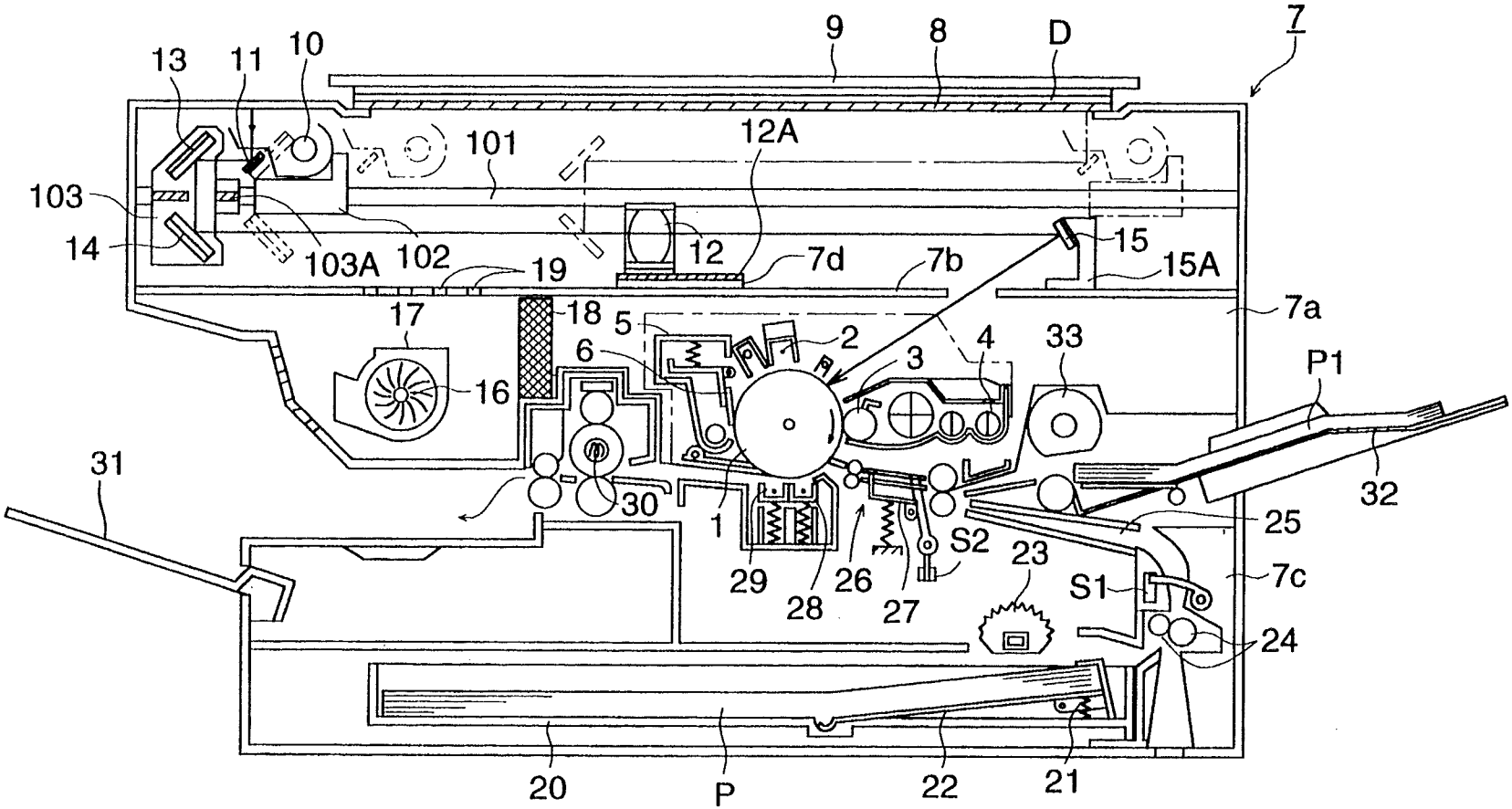
FIG. 1 is a front view showing the entire structure of an image forming apparatus according to the present invention.

FIG. 1 is a view showing the entire structure of an image forming apparatus. Numeral 1 is a photoreceptor drum, and numeral 2 is a charging electrode by which a predetermined amount of electric charges are supplied onto the entire surface of the photoreceptor drum 1. Numeral 3 is a developing unit with a toner replenisher 4, and numeral 5 is a cleaning unit with a cleaning blade 6 for removing toner remained on the photoreceptor drum 1. The foregoing units are integrally united with each other, and the unit is detachably provided into an upper frame *7a* of the image forming apparatus 7. Further, a platen glass 8 on which the document is placed, a document pressing plate 9 for pressing and holding the document when the document is placed on the platen glass 8, an exposure lamp 10 which is moved to a position, shown by one dotted chain line, by a guide rail (not shown in the drawings), the first reflection mirror 11, and a final reflection mirror 15 which is structured by the second and third reflection mirrors 13 and 14 in which the reflected light irradiated by the exposure lamp onto the document is received by the first reflection mirror 11, the reflected light being projected onto a fixed focal length lens 12 (hereinafter, called an image forming lens), the second and the third reflection mirrors being integrally formed to be 90° with each other, and which irradiates the photoreceptor drum 1 surface and forms an electrostatic latent image, is provided at the lower position of the platen glass 8 in the upper frame *7a*. In this connection, the system may be structured in the manner that the fifth and sixth reflection mirrors are provided and the sixth reflection mirror forms the electrostatic latent image.

Numeral 16 is an exhaust fan for exhausting ozone and heat generated in the image forming apparatus 7 to the outside of the apparatus. A suction opening 17 is provided in the exhaust fan. From the suction opening 17, toner particles scattered from the developing unit 3 and ozone generated from the charging electrode 2 are exhausted outside the apparatus through a removing filter 18. From a suction opening 19, the heat of the exposure lamp 10 generated in the optical system is exhausted outside the apparatus. When the reflection mirrors 13 and 14, formed to be 90° with each other, move by ½ of the movement amount of the first reflection mirror 11 through the guide member (not shown in the drawings), the optical length between the document D and the photoreceptor drum surface 1 is made constant. The entire foregoing mechanism is provided in the upper frame *7a*.

Numeral 20 is a sheet feed cassette which is provided at the lower position of the lower frame *7c* and on which recording sheets P are stacked. The recording sheet P follows this sequence: the front portion of the recording sheets P in the feeding direction is pushed up by a spring 21 through a pressing plate 22; the uppermost recording sheet P is fed by a half moon-shaped sheet feed roller 23; the recording sheet P is conveyed by a conveyance roller 24 and a conveyance guide section 25 to a sheet feed conveyance guide section 26; the recording sheet P is temporarily stopped at a recording sheet stop member 27 in the sheet feed conveyance guide section 26; the sheet feeding operation is started so that the recording sheet P coincides with the toner image formed on the photoreceptor drum 1 surface; the toner image is transferred onto the recording sheet P by a transfer electrode 28; the recording sheet P is separated from the photoreceptor drum 1 surface by a separation electrode 29; the recording sheet is fixed by a thermal fixing unit 30; and following that, the recording sheet P is delivered onto a sheet delivery tray 31. Numeral 32 is a manual-feed tray, and recording sheets P1 on the tray are fed one sheet at a time to the sheet feed conveyance guide section 26 by a sheet feed roller 33 for hand-feeding. S1 and S2 are sensors provided respectively at the recording sheet P conveyance guide section 25 and the sheet feed conveyance guide section 26.

The upper frame *7a* and the lower frame *7c* are pivotally supported by a shaft (not shown in the drawing), and are structured in the manner that hose frames can be opened around the shaft from the near side of the operators.

Figure 2:
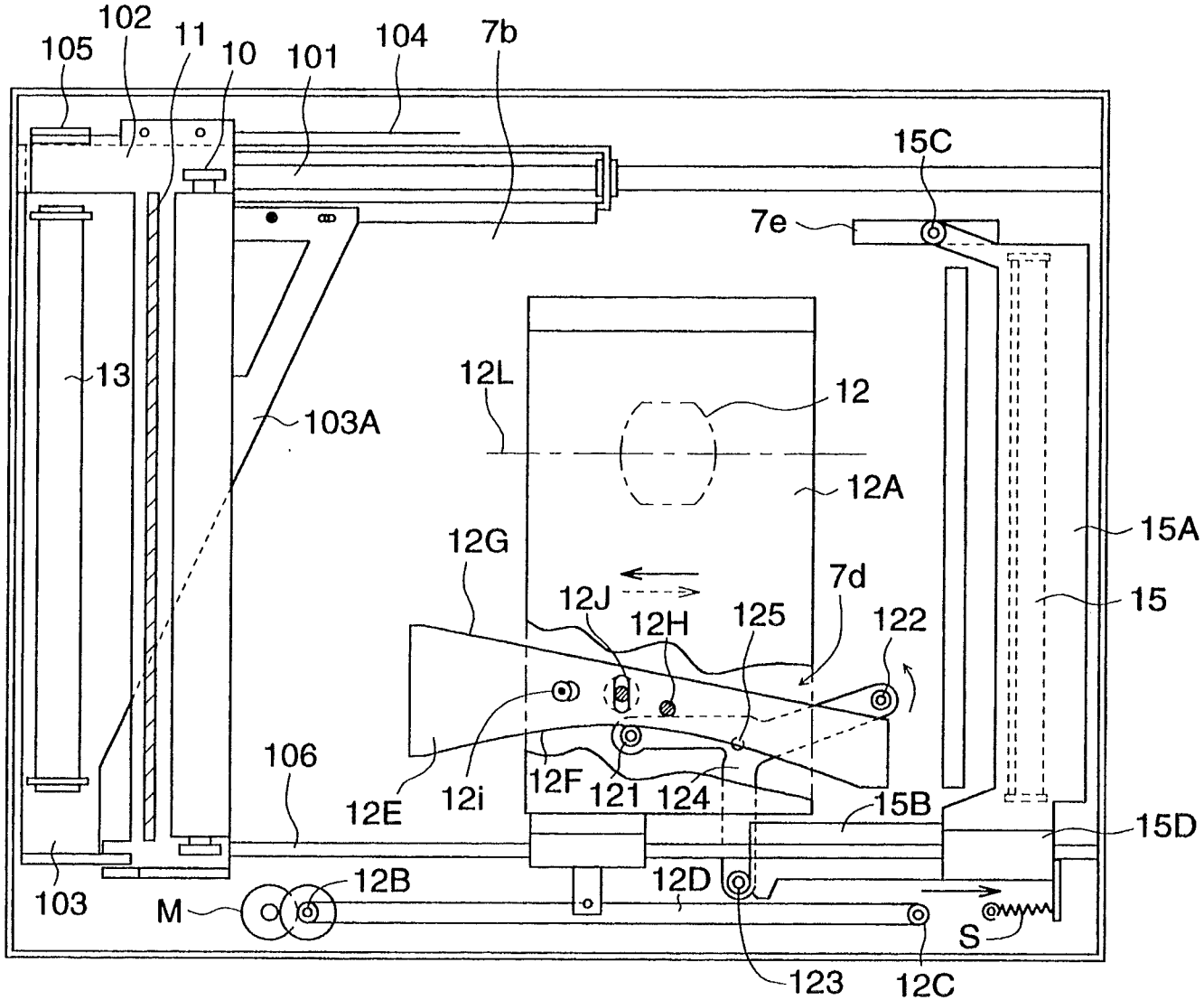
FIG. 2 is a plan view showing an optical system for image magnification change.

FIG. 2 is a plan view showing another example of the present invention and an optical system for image magnification change provided in the upper frame *7a*. The exposure lamp 10 is provided in the upper frame *7a* shown in FIG. 2, and the first guide member 101 is provided in the entire movement direction of the first reflection mirror 11. Numeral 102 is the first scanner unit, and the exposure lamp 10 and the first reflection mirror 11 are provided in the first scanner unit 102 as shown in the drawing. One end of the first scanner unit 102 is movably engaged with the first guide member 101. Numeral 103 is the second scanner unit, and the reflection mirrors 13 and 14, which are formed into a V-shape, are provided as shown in the drawing. A reinforcement member 103A is formed with respect to the moving direction of the V-shaped reflection mirrors 13 and 14 provided in the second scanner unit 103. One end of the second scanner unit 103 is movably engaged with the first guide member 101. In the case where the movement amount of the second scanner unit 103 is ½ of the movement amount of the first scanner unit 102, the following operations are conducted as a mean by which the optical length is maintained with respect to the image carrier 1: a portion of a wire 104, driven in the arrowed direction by a drive means (not shown in the drawing), is fixed to the first scanner unit 103; and the wire 104 is wound around a pulley 105 provided at one portion of the second scanner unit 103.

On the other hand, one end 15D of a mirror unit 15A, in which the final reflection mirror 15 is mounted, is movably provided in the second guide member 106 mounted in the upper frame *7a*, and also the other end 15C of the mirror unit 15A is engaged with a guide slot *7e* provided on a light-shielding plate *7b*. The lens unit 12A in which the image forming lens 12 is housed is provided so as to form a gap *7d* in the light-shielding plate *7b*, and also a portion of the lens unit 12A is movably engaged with the second guide member 106 so as to be able to move in the direction of an optical axis 12L. One end of the lens unit 12A is fixed to, for example, a portion of a timing belt 12D which is mounted around the pulleys 12B and 12C rotatably provided on the light-shielding plate *7b*. M is a motor for driving the pulleys 12B and 12C. Numeral 12E is a lens cam fixed onto the bottom portion of the lens unit 12A, a cam surface for enlargement 12F and a cam surface for reduction 12G are formed approximately in parallel with the optical axis 12L in the lens cam 12E. The lens cam 12E is provided so that the lens cam 12E can be rotated around a support shaft 12H provided on the lens unit 12A. The position of the lens cam 12E is adjusted around the support shaft 12H by an eccentric member **12*i* provided on the lens unit 12A, and the lens cam 12E is fixed to the bottom portion of the lens unit 12A by a screw 12J**.

An operating member 124, having respectively the first operating member 121 which is operated on the cam surface 12F for enlargement, the second operating member 122 which is operated on the cam surface 12G for reduction, and the third operating member 123 which operates the operated section 15B protruded from a portion of the mirror unit 15A, is rotatably provided on a shaft 125 with respect to the light-shielding plate *7b*. A spring S is provided in the mirror unit 15A so that an end of the operated member 15B is always contacted with the third operating member 123.

Figure 3:
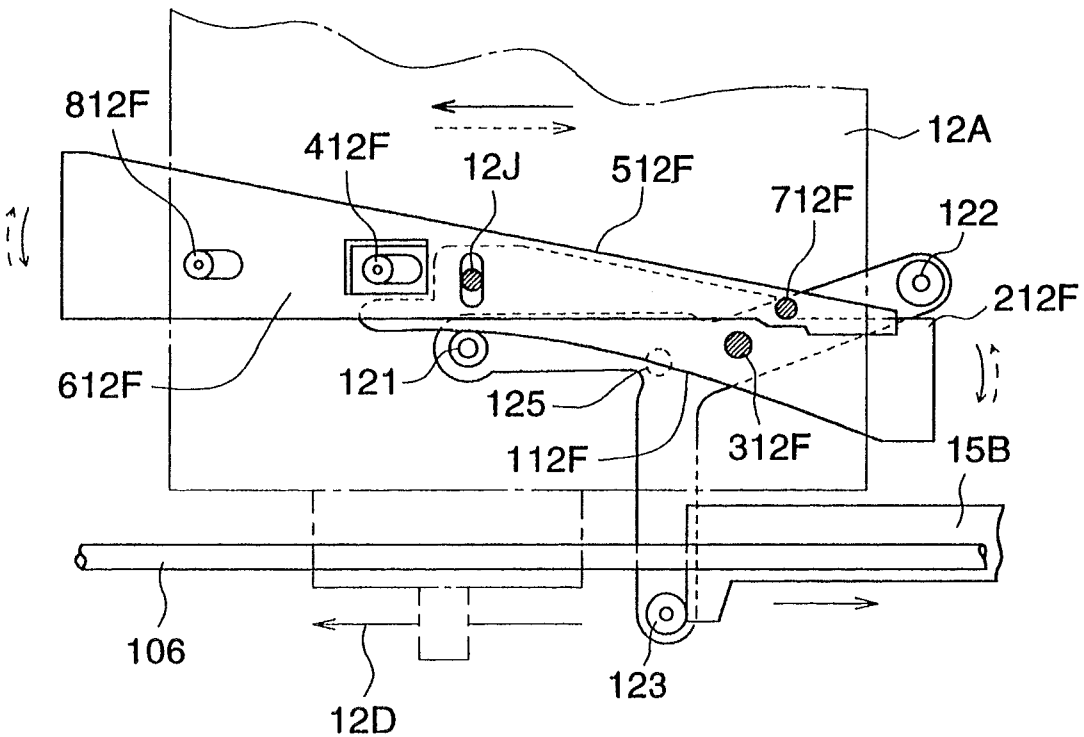
FIG. 3 is a plan view showing another example of the optical system for image magnification change according to the present invention.

FIG. 3 is a view showing another example of the lens cam 12E shown in FIG. 2. In the drawing, a lens cam 212F, on which the cam surface 112F for enlargement is formed, is rotatably provided around a support shaft 312F, and is provided in the lens unit 12A so that the position of the lens cam can be adjusted by an eccentric member 412F. A lens cam 612F, on which a cam surface 512F for reduction is formed, is rotatably provided around a support shaft 712F, and is provided on the lens unit 12A so that the position of the lens cam 612F can be adjusted. After adjustment, the lens cams are fixed by screws 12J.

In the optical means for image magnification change structured as described above, in the example shown in FIG. 2, when a switching device (not shown in the drawing) for the optical means for image magnification change provided in the image forming apparatus 7 is switched, and the lens unit 12A is moved by a motor M through a timing belt in the arrowed direction shown by a solid line, the lens cam 12E is moved in the same direction. When the first operating member 121 is operated by the cam surface 12F for enlargement, the operating member 124 is rotated counterclockwise around the shaft 125. The operated member 15B of the mirror unit 15A is pushed toward the right direction by the third operating member 123 when the above described rotation is conducted. That is, the fourth reflection mirror 15 is moved in the reverse direction in order to form an enlarged image of the document image with respect to the movement direction of the image forming lens 12 which is housed in the lens unit 12A. Next, when the lens unit 12A is moved in the dotted arrowed direction by the motor M through a wire 12D, the second operating member 122 is contacted with the cam surface 12G for reduction, and the second operating member 122 is rotated counterclockwise around the shaft 125 as described above. When this rotation is conducted, the operated member 15B of the mirror unit 15A is pushed by the third operating member 123 and moved toward the right direction. That is, the mirror unit 15A is moved in the same direction as the movement direction of the image forming lens 12, and the reduced image formation of the document image is conducted. Also in FIG. 3, the enlarged image formation and the reduced image formation are conducted in the same way as in FIG. 2.

Figure 4:
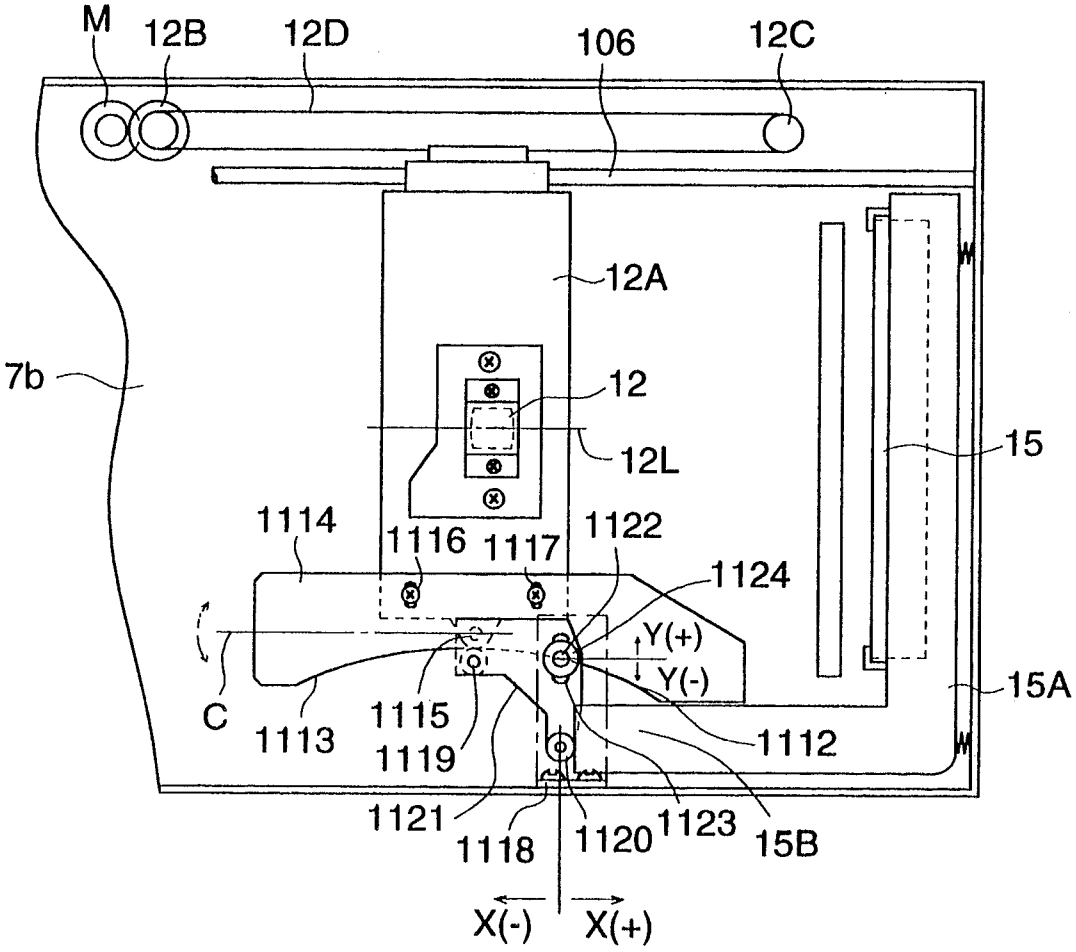
FIGS. 4(*a*) and 4(*b*) are plan views of another example of the optical system for image magnification change according to the present invention.
Figure 4:
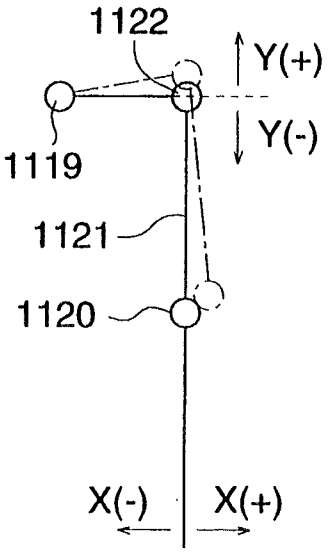

Next, an example shown in FIG. 4(*a*) will be described below. In order to form an enlarged image and a reduced image by the optical means for image magnification change as described in FIGS. 2 and 3, one end of the lens unit 12A is movably engaged with the second guide member 106 in the same way as described above so that the lens unit 12A, housing the image forming lens 12, can be moved in the optical axis 12L direction. Further, the lens unit 12A is fixed to a portion of the timing belt 12D, driven by the motor M. The timing belt 12D is stretched around the pulleys 12B, and 12C rotatably provided on the light-shielding plate *7b*, and which is driven by the motor M. In this example, a lens cam 1114, on one side surface of which a cam surface 1112 for enlargement and a cam surface 1113 for reduction are formed, is provided in the lens unit 12A. The lens cam 1114 is rotatably provided on the support shaft 1115 provided at a portion of the lens unit 12A, and is fixed by screws 1116 and 1117 after the position of the lens cam 1114 has been adjusted when moved clockwise and counterclockwise around a center line C.

On the other hand, an operating member 1121 having: the first operating member 1119 which is operated in contact with the cam surface 1112 for enlargement, the cam surface 1113 for reduction, and a central position for life-sized magnification; and the second operating member 1120, is rotatably provided around a support shaft 1122 supported by a holding plate 1118 fixed to the upper frame *7a*. The second operating member 1120 is contacted with the other end 15B of the mirror unit 15A which is provided in the upper frame *7a*, and which holds the final reflection mirror 15.

In the optical means for changing image magnification, a slot 1123 is formed perpendicularly to the optical axis 12L on the holding plate 1118; a bearing 1124 is engaged with the slot 1123; and the support shaft 1122 is rotatably supported by the bearing 1124. The bearing 1124 is fixed to the holding member 1118 by screws not shown in the drawing. The first operating member 1119 and the second operating member 1120 are structured in the manner that these members are positioned in the extended positions perpendicular to the support shaft 1122. In this example, when the position of the bearing 1124 is minutely adjusted along the slot 1123 in the direction perpendicular to the optical axis 12L, for example, when the support shaft 1122 is moved in the Y(+)-direction as shown in FIG. 4(*b*), since the first operating member 1119 is stopped at the position for life-sized magnification of the lens cam 1114, the operating member 1121 is rotated around the support shaft 1122; the second operating member 1120 is moved in the X(+)-direction; and the final reflection mirror 15 is also moved in the X(+)-direction by pressing the other end 15B of the mirror unit 15A. When, conversely, the support shaft 1122 is moved in the Y(−)-direction in the drawing, the operating member 1120 of the operating member 1121 is moved in the X(−)-direction.

Here, when the distance between the support shaft 1122 and the first operating member 1119 is 50 mm, and the distance between the support shaft 1122 and the second operating member is 80 mm, a variable magnification error is adjusted by the minute adjustment as shown in a table below.

TABLE 1

| Moving amount of the support shaft (Y-direction) | | Reference position 0 | +1 (mm) | −1 (mm) |
|---|---|---|---|---|
| Magnification ratio | × 0.5 | 50.84 | 50.51<br>−0.33 | 51.14<br>+0.3 |
| | × 2.0 | 50.87 | 52.61<br>+1.74 | 49.67<br>−1.2 |
| | | | | Unit (mm) |

Relation between a moving amount of the support shaft in the Y-direction and a moving amount of the final reflection mirror in the X-direction (with respect to the magnification ratio 1.0), in each magnification ratio (×0.5,×2.0).

The present invention is structured as described above. Specifically, the present invention is structured as follows: one lens cam for magnification change is fixed to the lens unit in which the image forming lens is housed; cam surfaces for enlargement and for reduction are provided on both sides of the lens cam for magnification change; operating members are contacted with the cam surfaces for enlargement and for reduction; and an amount of movement, obtained when the operating members operate on the cam surfaces for enlargement and for reduction, is interlocked with the fourth reflection mirror. Due to this structure, an amount of movement of the lens cam for magnification change is approximately ½ of the conventional amount of movement. Accordingly, the lens cam for magnification change can be made smaller, so that an optical apparatus for exposure of the image forming apparatus can also be made smaller, which is an advantage.

Further, the present invention is structured as follows: the cam surfaces for enlargement and for reduction are formed on one surface of a lens cam for magnification change; one end of the operating member operating on the cam surfaces for enlargement and reduction is positioned at a reference position formed on an intermediate position of the cam surfaces; and when a support shaft of the operating member is only minutely adjusted in the direction perpendicular to the optical axis of the image forming lens, a movement error with respect to the fourth reflection mirror can be adjusted. Accordingly, even when there are errors to some extent on the cam surfaces for enlargement and for reduction, the errors can be easily eliminated by the minute adjustment of the support shaft, which is still another advantage of the present invention.

What is claimed is:

1. An image forming apparatus having optical means for image magnification change, said apparatus including a fixed platen on which a document is placed, an exposure lamp by which the document is exposed and scanned, a plurality of reflecting mirrors for reflecting an imagewise light emitted from the document onto a fixed-focus lens of a lens unit the fixed-focus lens transmitting therethrough the light reflected thereto by the plurality of reflecting mirrors, and a final reflecting mirror, which is one of said plurality of reflecting mirrors, for reflecting the light transmitted through said fixed-focus lens onto an image carrier to form an image thereon, said apparatus comprising:

(a) said lens unit accommodating said fixed-focus lens therein, said lens unit being movable in a same moving direction as said plurality of reflecting mirrors when a magnification change is performed;

(b) a lens cam member rotatably mounted to said lens unit, said lens cam member having a first cam surface for enlargement provided on one side thereof and a second cam surface for reduction provided on another side thereof;

(c) an operating member rotatably mounted to a main body of said apparatus, said operating member including a first operating portion that is engagable with said first cam surface for enlargement, and a second operating portion that is engagable with said second cam surface for reduction; and (d) engaging means for changing a position of said final reflecting mirror in accordance with a movement amount of said operating member when said first and second cam surfaces are engaged with said first and second operating portions respectively.

2. The image forming apparatus of claim 1, wherein said lens cam member is adjustable in position thereof with respect to said lens unit.

3. The image forming apparatus of claim 1, wherein said lens cam member comprises two separate elements, a first one of said elements having said first cam surface and a second one of said elements having said second cam surface.

4. The image forming apparatus of claim 3, wherein said first and second cam surfaces are separately adjustable in a position thereof with respect to said lens unit.

5. An image forming apparatus having optical means for image magnification change, said apparatus including a fixed platen on which a document is placed, an exposure lamp by which the document is exposed and scanned, a plurality of reflecting mirrors for reflecting an imagewise light emitted from the document onto a fixed-focus lens of a lens unit said fixed-focus lens transmitting therethrough the light reflected thereto by the plurality of reflecting mirrors, and a final reflecting mirror, which is one of said plurality of reflecting mirrors, for reflecting the light transmitted through said fixed-focus lens onto an image carrier to form an image thereon, said apparatus comprising:

(a) a lens cam member rotatably mounted to said lens unit, said lens cam member having a first cam surface for enlargement and a second cam surface for reduction, both said first and second cam surfaces being provided on one side of said lens cam member; and (b) said lens unit accommodating said fixed-focus lens therein, said lens unit being movable in a same moving direction as said plurality of reflecting mirrors when a magnification change is performed; and (c) an operating member rotatably provided around a shaft mounted on a main body of said apparatus, said operating member including a first operating portion engagable with said first cam surface for enlargement and engagable with said second cam surface for reduction, and a second operating portion for changing a position of said final reflecting mirror in accordance with a movement of said first operating portion when said first and second cam surfaces are engaged with said first operating portion, wherein a position of said shaft is adjustable to move in a direction perpendicular to an optical axis of said fixed-focus lens.

6. The image forming apparatus of claim 5, wherein said lens unit further comprises a support shaft, and wherein:

said lens cam member is provided to said support shaft so that said lens cam member is rotatable around said support shaft, thereby positions of both said first and second cam surfaces are adjusted to change image magnification.

* * * * *